United States Patent [19]

Pruitt

[11] 4,264,398

[45] Apr. 28, 1981

[54] MACHINE FOR WRAPPING TAPE AROUND AN OBJECT

[76] Inventor: Leonard H. Pruitt, 5312 Spring St., Racine, Wis. 53406

[21] Appl. No.: 67,120

[22] Filed: Aug. 16, 1979

[51] Int. Cl.[3] ..... B65C 3/12

[52] U.S. Cl. ..... 156/468; 156/486

[58] Field of Search ..... 156/392, 445, 468, 475, 156/486–488; 100/27, 28, 13, 8, 2, 3; 53/588

[56] References Cited

U.S. PATENT DOCUMENTS

| | | | |
|---|---|---|---|
| 2,269,621 | 1/1942 | Davis et al. | 156/468 X |
| 2,511,741 | 6/1950 | Schulz | 82/40 A |
| 2,834,499 | 5/1958 | Semkow | 156/486 |
| 3,031,368 | 4/1962 | Zent | 156/486 |
| 3,192,093 | 4/1965 | Tobey | 156/352 |
| 3,414,451 | 12/1968 | Sejda | 156/353 |
| 3,418,358 | 12/1968 | Sejda | 156/486 X |
| 3,547,731 | 12/1970 | Stuart | 156/392 |
| 3,547,737 | 12/1970 | Vici | 156/468 |
| 3,600,253 | 8/1971 | Dewenthal | 156/468 |
| 3,851,869 | 12/1974 | Damewood | 269/61 |

*Primary Examiner*—David A. Simmons
*Attorney, Agent, or Firm*—Arthur J. Hansmann

[57] ABSTRACT

A machine for wrapping tape around an object and including a rotatably mounted work piece chuck which opens up for receiving the object and then closes to rotate around the object while applying a pressure sensitive tape to the object. Tape presser members are employed for pressing the tape to the object as the chuck with the tape rotates around the object, and a knife cuts the tape. Powered cylinders are sequentially operated for rotating the chuck and for opening the chuck to insert and withdraw the work piece.

20 Claims, 14 Drawing Figures

MACHINE FOR WRAPPING TAPE AROUND AN OBJECT

This invention relates to a machine for wrapping tape around an object, and, more particularly, the object is a cylindrical object and one of an irregular shape along its length, such as a vehicle muffler pipe, and the machine is arranged with a chuck which opens for receiving the object and then rotating around it in applying tape thereto.

BACKGROUND OF THE INVENTION

The prior art is already aware of various forms of tape wrapping or applying machines. Examples of such prior art are found in U.S. Pat. Nos. 2,834,499 and 3,031,368 and 3,192,093 and 3,414,451 and 3,418,358 and 3,600,253. All of these patents show machines for applying tapes or labels to objects of various configurations, including cylindrical and rectilinear objects. These patents further show work piece chucks which receive and hold the work piece while the tape is being applied, and they also show that the so-called chuck is rotatable about the work piece and has some means for pressing the tape against the work piece, and the tape is then cut when the work piece is completely wrapped by one length of tape. Still further, the prior art is already aware of chucks or work piece holding devices which are segmented or which have separable sections which can be moved away from the remainder of the chuck for the opening of the chuck to insert and withdraw the work piece relative to the chuck, and examples of such are found in U.S. Pat. Nos. 2,511,741 and 3,851,869.

The present invention differs from the aforesaid prior art in that the present invention provides for a tape wrapping machine which is capable of receiving a bent type of object, such as a bend vehicle exhaust pipe, which cannot be inserted by axial movement into the machine, because of the bends along the pipe or object being taped. Therefore, it is necessary to move the pipe or object into the machine in a direction transverse to the longitudinal axis of the pipe, thereby providing for a segmented type of chuck which can be opened for reception of the work piece. Further, in the process of applying a tape to a vehicle pipe, as well as to other types of objects, it is critical that the tape be applied straight on the pipe and in a very secure manner so that it will remain on the pipe even through considerable handling and storage conditions, and the tape is utilized for identifying the pipe or like object. At the present time, tape is applied to these types of objects, and particularly including vehicle exhaust pipes, by a hand process which is time consuming, laborious, and often does not meet the required standards for having the tape straight on the pipe and being sufficiently pressed thereon to be secure for the purposes intended. Therefore, the aforesaid prior art does not at all suggest any complete apparatus or machine which applied tape onto cylindrical objects having bends along the lengths thereof, such as vehicle exhaust pipes and to do so in a manner which meets the standards of taping as they pertain in this particular art.

Still further, the present invention differs from the prior art and is an improvement thereover in that the aforesaid prior art does not provide for a taping machine which positively and securely affixes or presses the leading end of a tape against the object and then cuts the tape and then finally presses the trailing end of the cut tape against the object, all to have the tape securely wrapped around the object. In contrast, the prior art at best provides a machine which initially requires that the tape be manually applied to the object at the leading end of the tape, or thereabouts, and then the remainder of the tape is applied to the object, though not necessarily by the desired pressing of the tape against the object, and again the trailing end of the tape is not finally pressed against the object. That is, the present invention provides a taping machine which is fully automatic and only requires that the operator place the work piece into the machine and from that point forward the machine does all of the remaining work.

Another distinction of the present invention over the prior art is that the present invention actually operates to stretch the tape onto the work piece in that the tape applying mechanism of the present invention is a biased or spring-loaded presser member which causes the tape to be initially pressed against the work piece and then stretched for wrapping the tape around the work piece in at least one full turn. Still further, in accomplishing this invention and still speaking with respect to contrast over the prior art mentioned, the present invention requires that the work-piece chuck rotate only one revolution in completely applying the tape for one full turn on the work piece, whereas the prior art mentioned above in some instances requires as much as three revolutions of a chuck or the like. Still further, the tape is applied in the present invention by means of overlapping the ends of the tape to fully secure the tape to the work piece, and the wrap is actually slightly over 400 degrees of rotation in the present invention.

In summary, the present invention provides a tape wrapping machine which is fully automatic in the process of wrapping a tape around an object for more than 360 degrees of the object's periphery, and to do so by one revolution of the machine and overlap the ends of the tape being applied to the object and to stretch the tape while applying it and thereby having the tape straight and secure on the object. The aforementioned objectives are all accomplished even though the object is one of an irregular shape in its length, such as a vehicle exhaust pipe having bends along its length, and the machine is nevertheless adapted to completely surround the portion of the object which is to receive the tape and thus completely enclose the object while the tape is being applied thereto, and a segmented chuck is utilized for this purpose.

Other objects and advantages, and other manners in which the present invention distinguishes over the prior art, will all become apparent upon reading the following description in light of the accompanying drawings.

BRIEF DESCRIPTION OF THE DRAWINGS

FIG. 5 is an end elevational view of FIG. 4.

FIG. 6 is a sectional view taken along the line 6—6 of FIG. 4.

FIGS. 7, 8, and 9 are side elevational views, similar to FIG. 4, and showing the segmented chuck and its attached parts in its sequential stages of operation.

DETAILED DESCRIPTION OF THE PREFERRED EMBODIMENT

Figures 1, 2, 3:
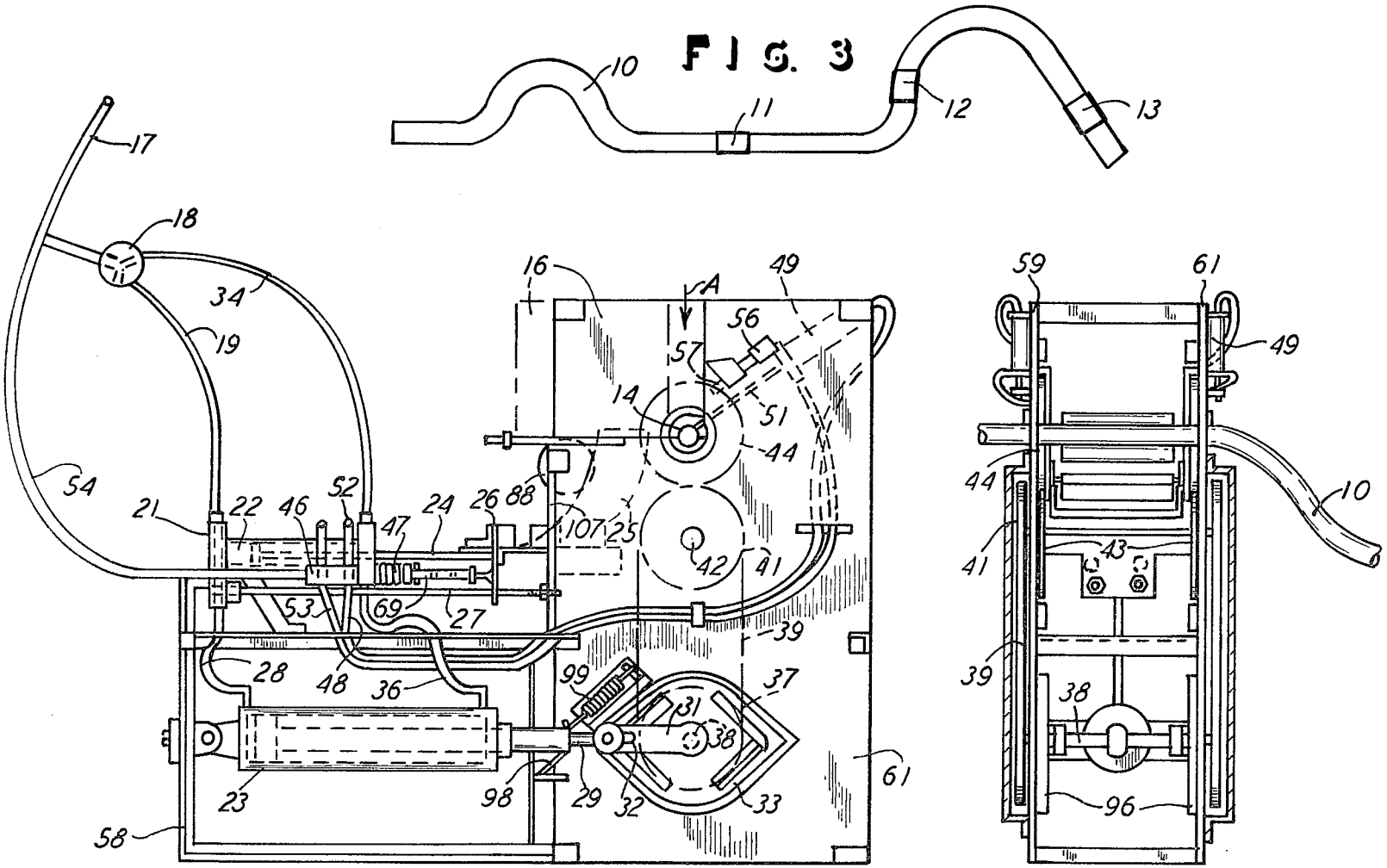
FIG. 1 is a side elevational view of a tape wrapping machine of this invention and with parts thereof removed.
FIG. 2 is an end elevational view of the machine shown in FIG. 1.
FIG. 3 is a side elevational view of a vehicle exhaust pipe showing three tapes applied thereto.

FIGS. 1 and 2 show the overall machine, and FIG. 3 shows the work piece, in the form of a vehicle exhaust pipe 10 which is placed into the machine and has the tapes 11, 12 and or 13 applied thereto. It will of course be noted and understood that the pipe 10 is of a cylindrical shape along its length, but it also has the various bend shown in FIG. 3, and thus the machine of this invention is made to open up to receive the pipe 10 without inserting the pipe 10 axially of the pipe's length into the machine, since that would be impossible to do. FIG. 2 shows the pipe 10 inserted therein, and the machine has an opening 14 for receiving the pipe 10 when a segment 16 of the machine is moved from the solid line shown and to the dot-dash line position in FIG. 1 to thus permit the pipe to be inserted into the machine in the direction of the arrow designated A. Once the pipe is in the machine, then the chuck holding the pipe, and that is the portion surrounding the opening 14, rotates about the pipe 10 to apply the tape thereto, as some of the chuck parts rotate.

For accomplishing the rotation of the machine chuck which will be described later, it will be seen and understood that the machine is operated by a power source of pressurized fluid, such as air from a supply line 17. A valve 18 is controlled by the operator and directs the pressurized air to the air line 19, and the air is directed to a timing valve 21 of conventional design and from there it passes to a cylinder assembly 22 and to a second cylinder assembly 23. The rod 24 of the assembly 22 connects with the movable segment 16 through a plate 26 and a member 25 which is suitably attached to the segment 16. Thus, upon actuation of the assembly 22, the segment 16 is moved back and forth and the chuck central opening is thus opened and closed for insertion and removal of the work piece.

When the plate 26 moves to the right, as seen in FIG. 1, it engages the nut shown on the right end of control rod 27 which is connected with the valve 21 and thus opens the valve 21 to allow the air presure to go to the line 28 and thus into the assembly 23. The rod 29 of the assembly 23 is connected with a rotatable arm 31 having a slot 32 thereon which thus permits the end of the arm 31 to move in the counterclockwise direction about a track designated 33 while the rod 29 moves to the right, as viewed in FIG. 1. The arm 31 and rod 29 stop in that one-half revolution position, and the operator then switches the valve 18 to direct the air pressure to the line 34 and opening the line 19 to exhaust the thus directing the air pressure to the line 36 to have the rod 29 retract to its original position shown in FIG. 1.

In that action, it will be seen and understood that there is a sprocket 37 on the shaft 38 connected with the arm 31, so the sprocket 37 rotates with the rotation of the arm 31. A sprocket chain 39 extends to a second sprocket 41 mounted on a shaft 42 which also carries a gear 43. Gear 43 is in mesh with a gear 44 included in the chuck of the machine, and thus the gear 44 is rotated in the clockwise direction, as viewed in FIG. 1 and it carries the taping and cutting mechanism for applying a length of the tape to the work piece in the one cycle or revolution just described. It will also be understood, and more fully described later, that the gear 44 is segmented and moves along with the part 16 so that approximately a quarter section of the gear 44 moves away from the remainder of the gear 44 for the insertion and removal of the pipe 10 or the like, as mentioned.

Continuing with the general description, when the cylinder 22 extends and the plate 26 is moved to the right, as viewed in FIG. 1, then the air switching valve 46 is released and moves under the influence of the spring 47 to direct the air pressure into the air line 48 which connects with cylinders 49 on each side of the machine, and that extends rods 51 which bear down onto the work piece 10 on each side of the taping location to hold the piece 10 in position during the taping action. That hold down action thus occurs before the cylinder 23 is energized and the consequent taping action commences. Also, with further respect to the pneumatics shown, when the segment 16 is in its closed position to the right, as viewed in FIG. 1, the rod 24 is held to the right even though there is pressure in the rod end of the assembly 22 which is always connected with the manifold 52 which limits that air pressure and to which the line 36 is also connected. However, upon releasing the segment 16 and moving it to the left, as viewed in FIG. 1, the assembly 22 is free to retract under the influence of the air pressure at the manifold 52, and thus the segment 16 is moved to the left by the assembly 22. Also, pressure is directed to the line 53, through the switching valve 46 which also always has line pressure presented thereto through the line 54, and the pressure in the line 53 is exposed to the cylinder assemblies 49 which control the rods 51.

It will also be seen and understood with respect to the general description being made at this point that the machine includes a frame 58 for supporting the parts described, and FIG. 2 particularly shows that the frame includes the left hand plate 59 and the right hand plate 61 and crossover members extending therebetween, as shown. Further, FIG. 2 shows that the sprockets 37 and 41 and the gears 44 exist in duplicates in that they are in complete sets on each side of the machine, and also the clamping or hold down mechanism 49 is on each side of the machine to engage the work piece 10 at locations on each side of the location where the tapes are being applied along the length of the work piece 10.

In furtherance of this general description, it will be understood that when the assembly 22 contracts, the rod 27 is released for movement to the left, as viewed in FIG. 1, and the valve 21 is automatically spring operated to close the flow to the line 28, as required, and only when line 19 is again pressurized will the assembly 22 extend to close the segment 16 and to again pressurize the line 28 in a time delayed action described and thus pressurize the cylinder 23 for a repeat of the cycle described.

Figures 2, 3, 4:
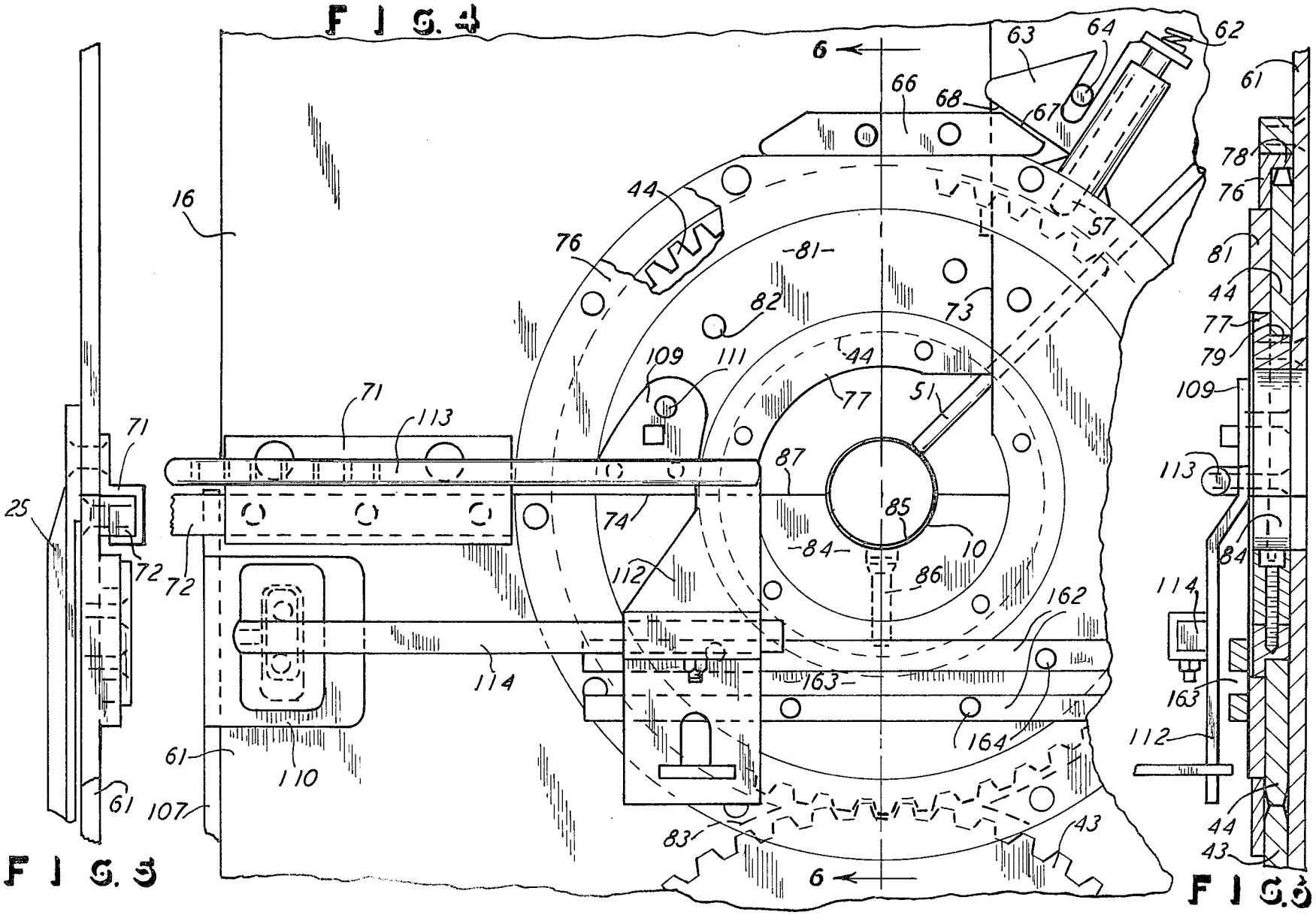
FIG. 4 is an enlarged side elevational view of a fragment of the machine shown in FIG. 1.
Figure 7:
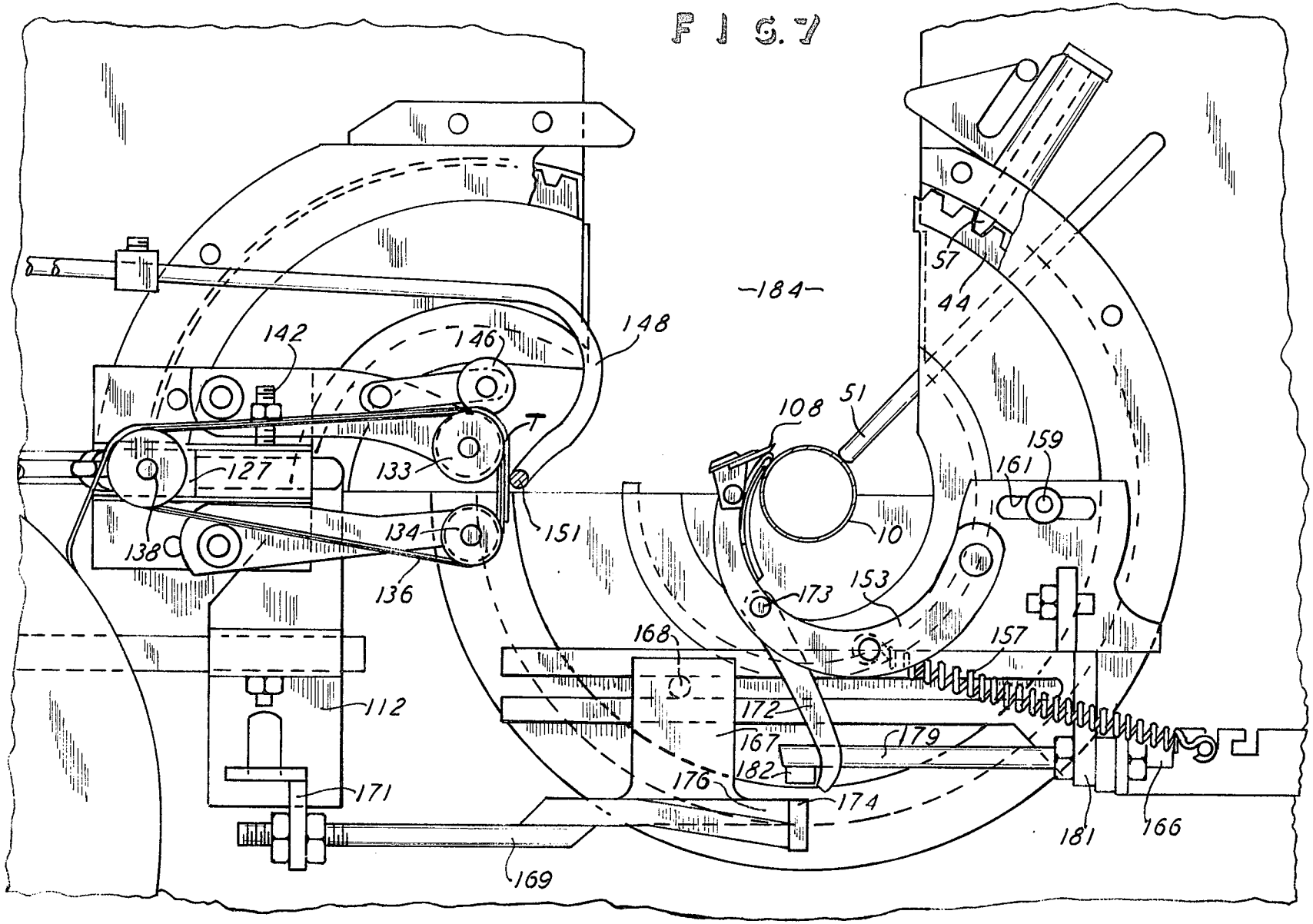
Figure 3:
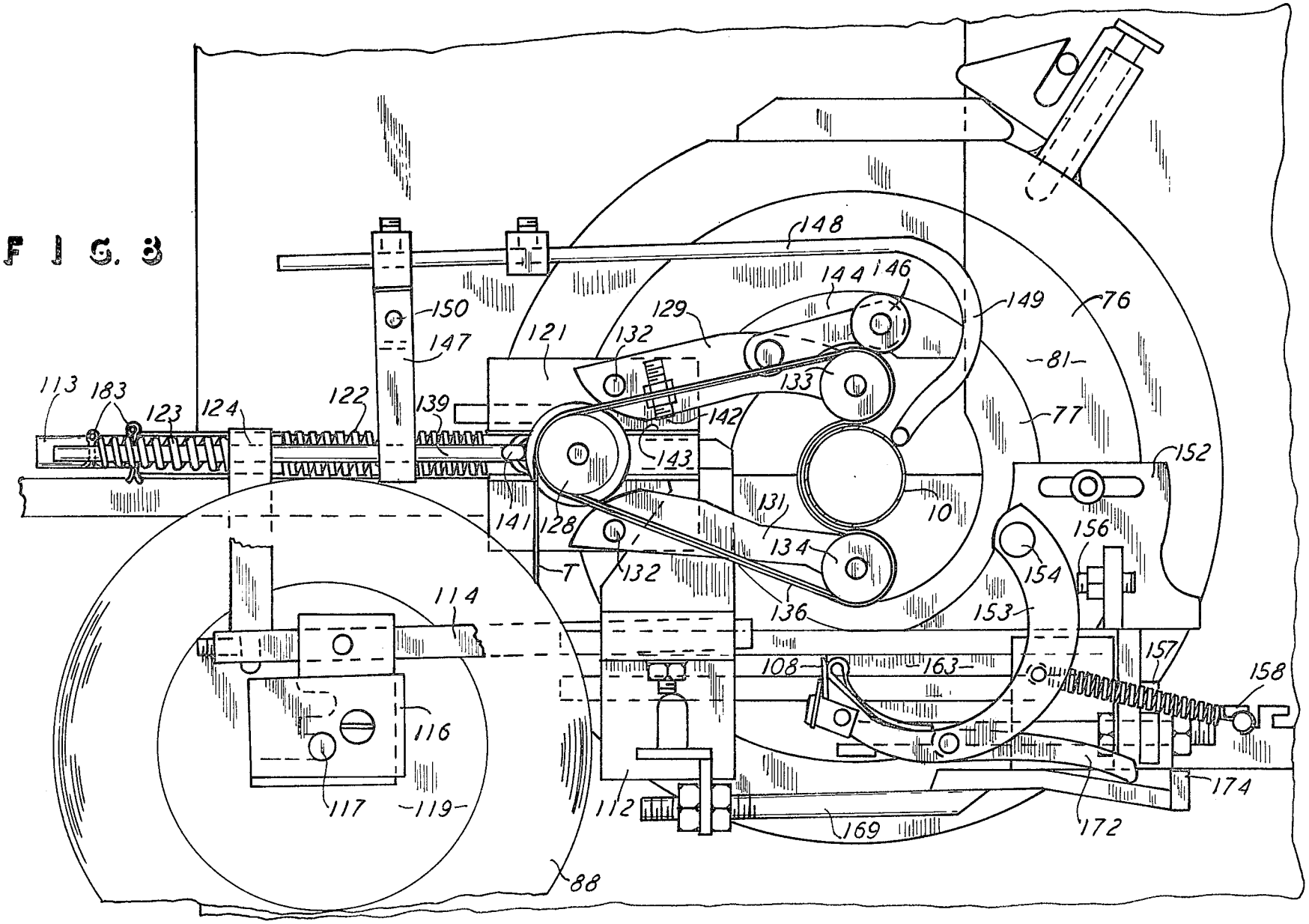

FIGS. 4 and 7, respectively show the closed and open position of the segment 16. FIG. 4 shows that the gear locking pin 57 is under the influence of a compression spring 62 which is suitably supported on the frame or housing 56 to bear downwardly on the pin 57 and cause it to engage the teeth of the gear 44 and thus hold it against rotation. Of course it will understood here and throughout the description that the unit is two-sided, and thus there are two gears 44 and two pins 57 for holding the gears. To release the gears, a cam 63 is connected with the pin 57 and is guided in up and down motion by means of a pin 64 on the frame 58. A finger 66 is attached to the segment 16 and has a surface 67 which engages the undersurface 68 of the cam 63 when the segment 16 is moved to the right to thus raise the pins 57 and thus release them from holding the gears 44. FIG. 4 also shows the clamping pin or finger 51 which is down against the work piece 10, and the finger 51 is actually a piston rod extended from the cylinder assembly 49 which has the air lines 48 and 53 connected at opposite ends thereof for alternate pressurizing thereof and thus clamping and releasing of the work piece 10 in accordance with the positioning of the plate 26 and the rod 69 attached thereto and connected with the switching valve 46 which is of a conventional nature for passing air pressure to the lines 36, 48, and 53, as needed and as described and shown, and the rod 69 is under the influence of the spring 47 to position the rod 69 and thus the valve 46 in accordance with the positioning of the plate 26 which is under the influence of the rod 24.

FIGS. 4 and 5 show that the member 25 is bolted to the segment 16 which also has a channel 71 attached thereto. The channel 71 snugly slides on a rail 72 affixed to the stationary frame portion 61, and thus the segment 16 can slide to the left and right on the rail 72. Of course there is a similar arrangement on each side of the machine.

The segment 16 is in the nature of a quarter segment and it mates with the remainder three-quarter portion of the chuck along the lines designated 73 and 74. FIGS. 4, 6, and 7 best show the chuck which includes an outer circular ring 76 affixed to the frame piece 61, and there is an inner circular ring 77 also affixed to the plate or frame piece 61, such as by the screws shown. The gear 44 is actually a ring gear, and FIG. 6 shows that the ring pieces 76 and 77 have inner circular extensions 78 and 79, respectively, for trapping the ring gear 44, as shown. A ring 81 is disposed and trapped between the pieces 76 and 77 and is affixed to the ring gear 44 by means of the screws 82 to rotate with the gear 44. It will also be noticed in FIG. 4 that the ring 76 has an opening 83 for permitting meshing between the gear 44 and the gear 43. It will of course be understood that the chuck arrangement described exists on each side of the machine, and thus the two gears 44 are rotatably supported and the two rings 81 rotate with the respective gears 44 which rotate in unison. Finally, an inner chuck member 84 is of a semi-circular configuration and snugly nests in the lower half of the ring member 77 and is affixed thereto by the bolt 86 and extends to a top surface on a horizontal plane and designated 87. The jaw 84 has a semi-circular opening 85 which receives the cylindrical work piece 10, and it will be seen that the rod or finger 51 bears down on the work piece 10 to hold the work piece in the semi-circular recess 85. It will now be seen and understood that the tape roll 88, as seen in FIGS. 1 and 8, for instance, can be suitably mounted on the rotatable ring member 81 and thus revolve around the work piece 10 in applying the tape thereto.

Figure 10:
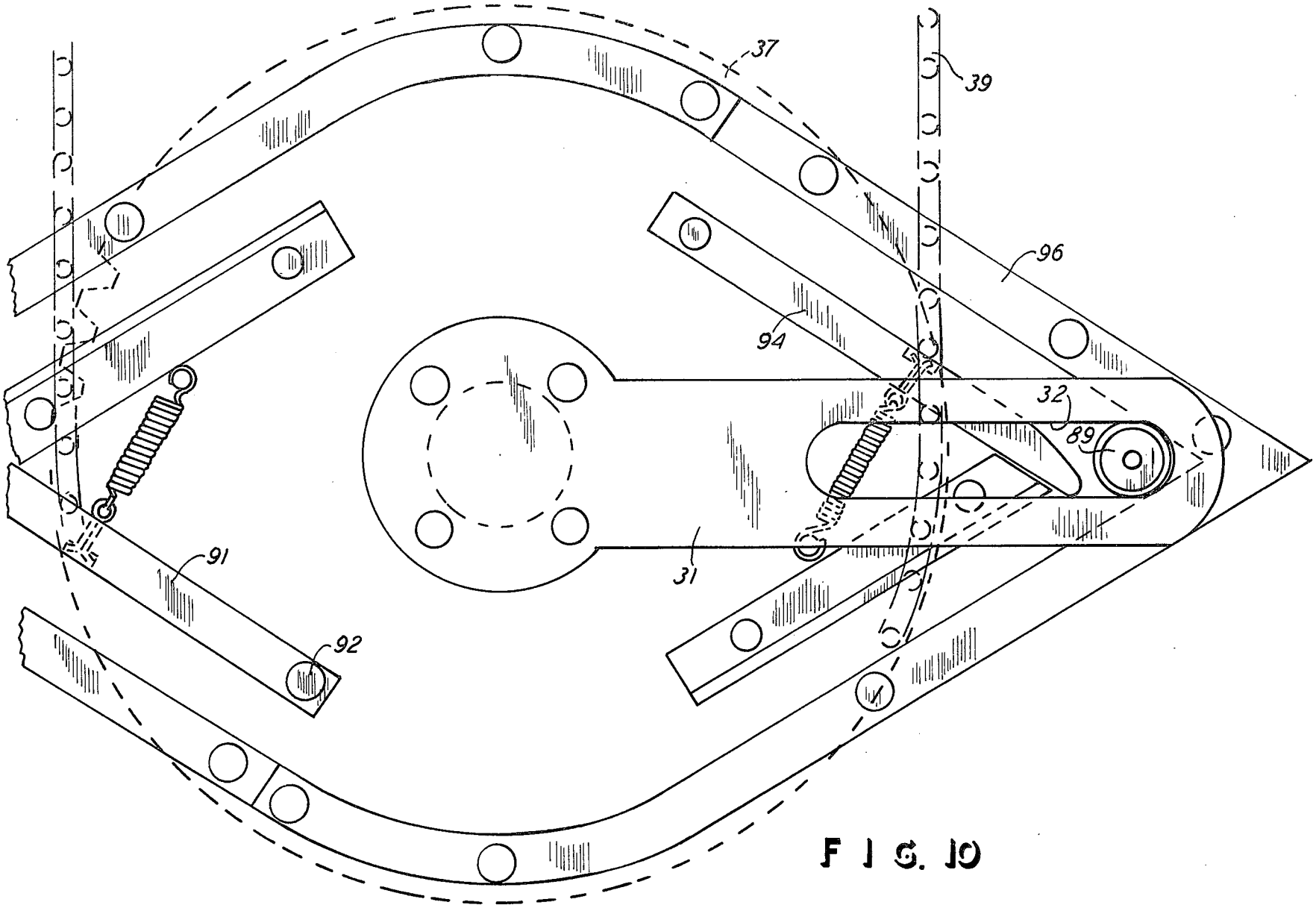
FIGS. 10 and 11 are enlarged side elevational views of fragments of the machine shown in FIG. 1.
Figure 11:
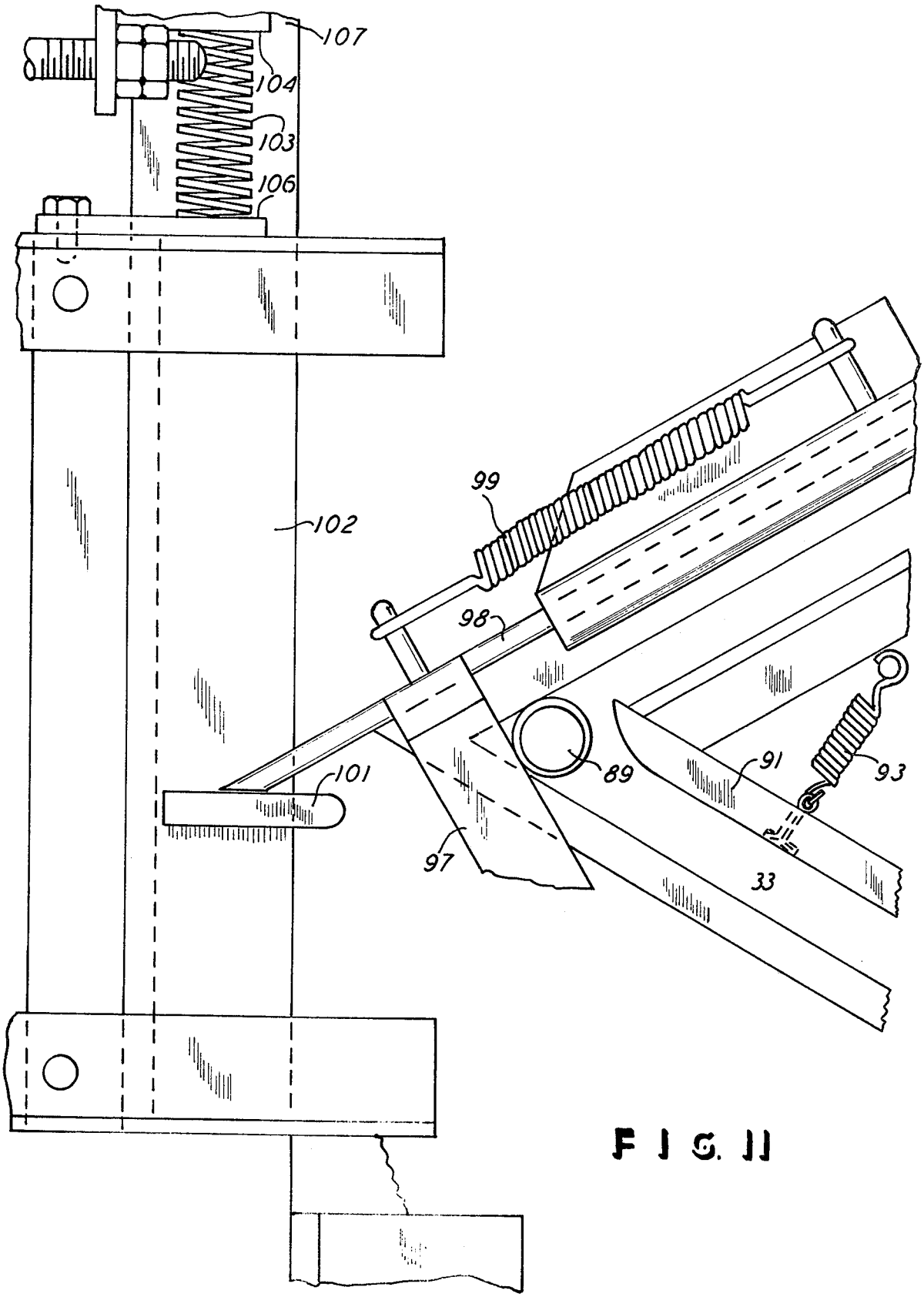

Referring again to the drive mechanism for the rotation of the two spaced-apart ring gears 44, as just described, the piston rod 29 and the rotatable arm 31 are connected by a wrist pin 89, as seen in FIG. 11 which is actually a continuation of the lefthand end of FIG. 10. A guide member 91 is pivoted about the fixed pin 92 and is urged upwardly by the spring 93 to thus direct the wrist pin 89 into the first portion of the track 33 as the wrist pin commences its counterclockwise movement about the track 33, as previously mentioned. A guide member 94 is on the far end of the track piece 96 which is affixed to the machine frame, and the member 94 serves the purpose like that of the member 91 when the wrist pin 89 is in the position shown in FIG. 10 and thus the wrist pin 89 will continue in its counterclockwise direction of movement and carry the arm 31 with it to thus impart the rotation to the sprockets 37 and ultimately impart clockwise rotation to the gears 44.

When the wrist pin 89 returns to the position shown in FIG. 11, it abuts a piece 97 which is affixed to a finger 98 and which is under the influence of a tension spring 99 pulling upwardly and to the right on the finger 98, as viewed in FIG. 11. The lower end of the finger 98 contacts a shelf 101 in its lowered position such as that shown in FIG. 11 when the wrist pin 89 is bearing downwardly on the piece 97. A vertically disposed and movable piece 102 is slidably supported on the machine frame and is connected with the shelf 101 and is thus depressed or moved downwardly by the finger 98. A compression spring 103 pushes upwardly on the piece 102 at the shoulder 104, and the spring 103 rests on fixed seat 106 on the frame of the machine. As seen in FIGS. 1, 4, and 11, the upper end of the vertically movable piece 102 has an extension 107 which extends above the horizontal center line 74 and thus overlaps the movable segment 16 to thereby lock the segment 16 in the holding position and to the right, as shown in those figures. Of course the downward movement of the finger 98 lowers the locking extension 107 to a position below the center line 74 and thus permits the segment 16 to move to the left for opening the chuck. A cage 110 is one 107 and is slidable on 61.

Figure 9:
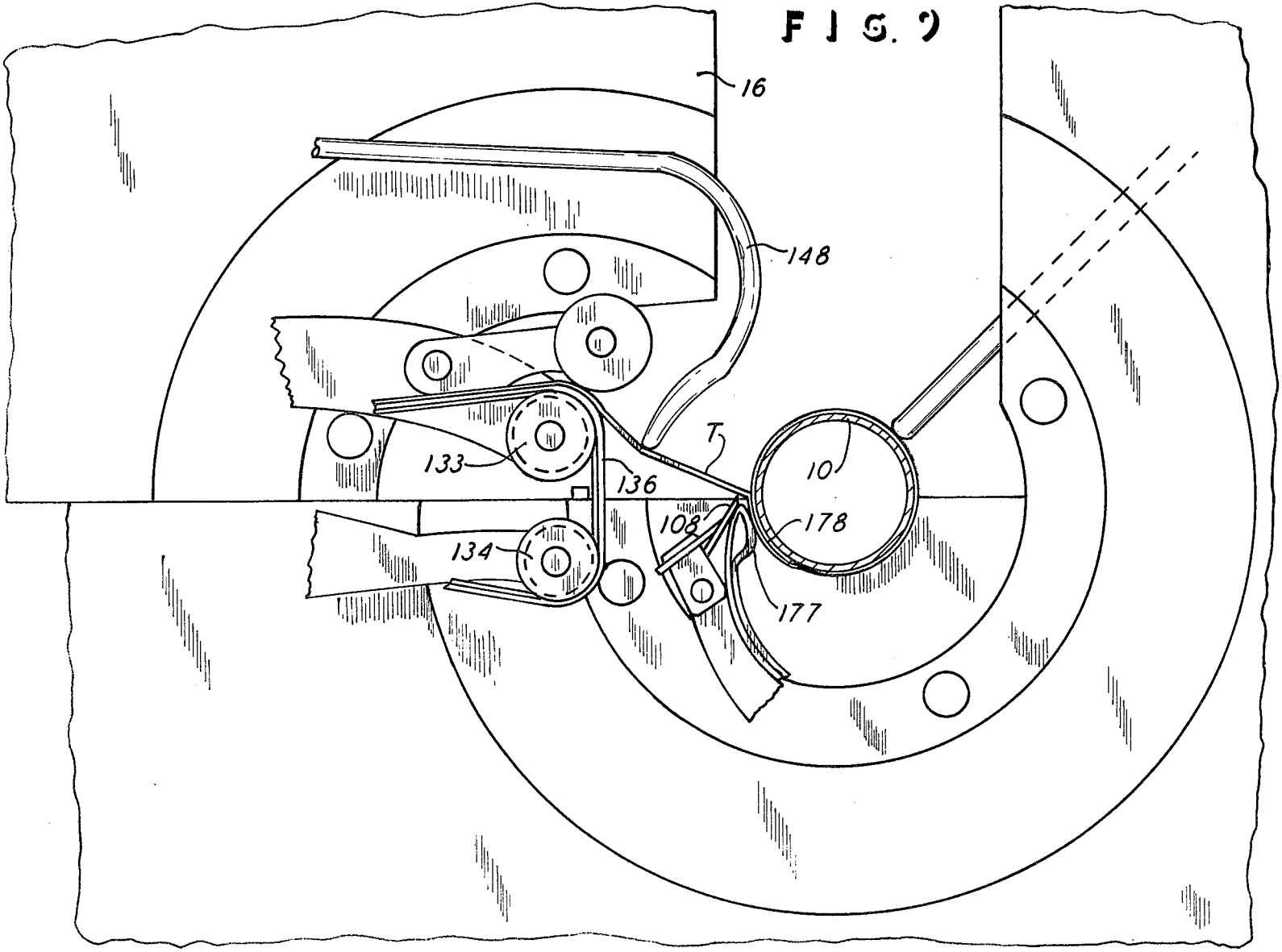
Figure 12:
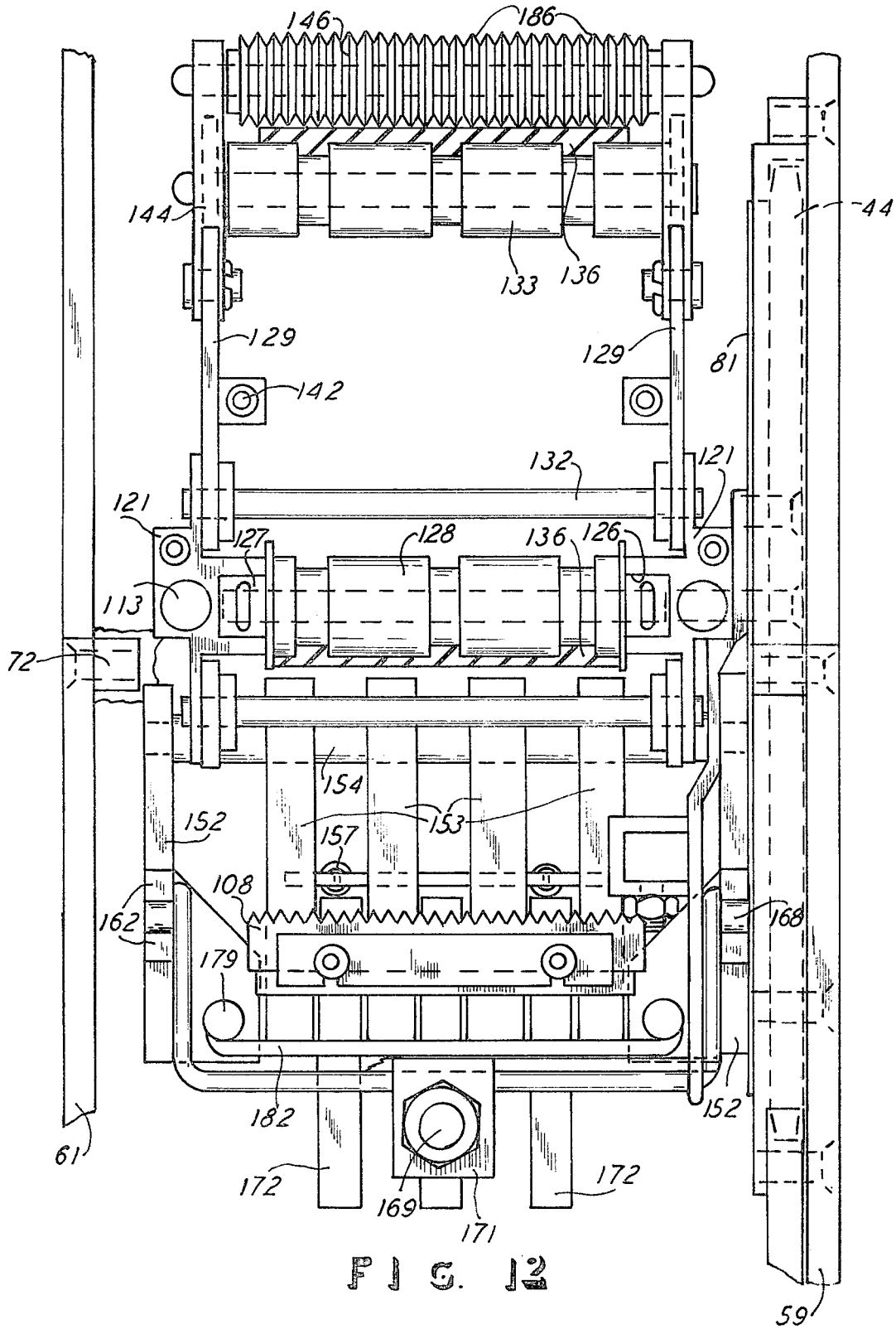
FIG. 12 is an enlarged end elevational view of a fragment of the machine as shown in FIG. 2.

The tape head, including the tape roll 88 and its supporting members and tape cutting knife 108, shown in FIGS. 7, 9, and 12, is rotatably mounted on the ring 81 to rotate therewith one complete revolution around the work piece 10. To support the tape roll 88, a plate 109 is bolted to the section of the ring 81 which is included in the separable segment 16, by means of bolts 111. A plate 112 is affixed with the plate 109, such as through the two arms 113 with all welded together or like assembly, and the plate 112 carries tape roll support arms 114. FIG. 8 shows that a tape spool bracket 116 is adjustably mounted for sliding along the support arms 114 and carries a centered shaft 117 and a tape support spool 119. Thus the tape can be fed off the roll 88, such as along the end designated T, and onto the work piece.

The two arms 113 each receive a plate 121 which is abutted thereon by means of a heavy spring 122 and a lighter spring 123 which is then in abutment with a guide post 124 affixed with and upstanding from the tape support arms 114. FIG. 12 shows that the plates or supports 121 have inwardly faced openings 126 which receive slide blocks 127 which in turn rotatably support a roller 128 extending between the members 121 as seen in FIG. 12. Thus, the springs 122 and 123 force in opposite directions relative to the position of the roller 128, and this will be more fully appreciated hereinafter. Two arms 129 and 131 are pivotally mounted on pins 132 for pivot support of the arms 129 and 131 on the support members 121. The extending ends of the arms 129 and 131 rotatably support rollers 133 and 134, respectively. An endless belt 136 is stretched over the three rollers 128 and 133 and 134, and the belt is utilized for guiding the tape T onto and around the work piece 10 as the entire chuck or head revolves about the work piece 10. In this regard, the rollers 133 and 134, along with the belt 136, can be considered the first presser means or member operating to press the pressure-sensitive tape T with its gum side exposed to the work piece 10 and against the work piece 10.

Of course when the segment 16 is in the retracted or open position of FIG. 7, then the presser head just described is also retracted and the rollers 133 and 134 are adjacent each other, as shown in FIG. 7 since there is no pressure against the belt 136 from the work piece 10. However, when the pressure head is moved against the work piece to the position shown in FIG. 8, then the rollers 133 and 134 are forced apart by the work piece itself, and the tension in spring 122 forces the presser head toward the work piece. That is, there is a slide block 127 which is supported in each of the members 121 and which receives the pins 138 for rotatable support of the rear roller 128. A rod 139 has a hook 141 which engages a loop shown on the block 127, and the spring 123 is centered on the rod 139 to thus urge the rod 139 to the left, as viewed in FIGS. 7 and 8 and against the pressure from the spring 122 acting on the members 121. In this manner, the force of the tape 136 against the work piece 10 creates pressure in the spring 122 and that is a heavier spring than the spring 123 which is thus overcome and therefore the rear roller 128 can slide to the right, as shown in FIG. 8, when the rollers 133 and 134 are on opposite sides of the work piece 10. In this manner, tension is retained in the belt 136 and likewise tension is retained in the tape T so that it is actually stretched and firmly applied to the work piece 10 while the presser head is revolving around the work piece 10. A stop 142 is attached to the arm 129 and abuts the surface 143 of each member 121 to limit the downward pivotal movement of the arm 129 and thus also the arm 131 through the connection with the belt 136. Also, an arm 144 is pivotly mounted on the arm 129 and carries a roller 146 which is on the outside of the tape T since the tape T is actually passing between the rollers 133 and 146, and thus the roller 146 further assures that the tape T will stay with the belt 136 and be stretched thereby and firmly applied to the work piece 10. The roller 146 also assures that the tape T will be pulled off its supply roll 88 to stretch around the work piece 10.

A standard 147 is supported on the pin 139 and in turn supports a finger 148 which has a hook 149 extending around the upper rollers 133 and 146 to engage the tape T through the portion designated 151, as seen in FIG. 7. With this arrangement, the finger 148 will hold the tape T against the belt 136 until the tape is pressed against the work piece on the left side thereof as the presser head moves rightwardly to press the tape T against the work piece. When the presser head is revolving around the work piece as described, then the finger 148 will pivot slightly counterclockwise, about its mounting pin 150 so that it moves around with the presser head in a free manner after serving its purpose of positioning the tape T so that it will be automatically and securely presented to the work piece 10, as described.

Figure 14:
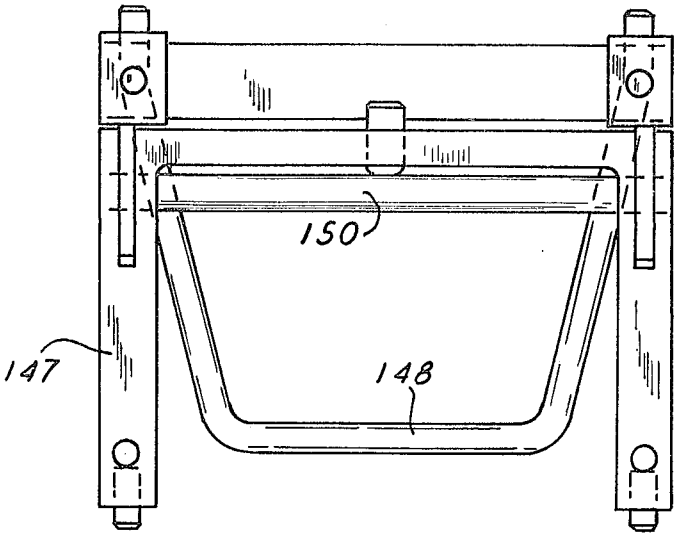
FIG. 14 is an end elevational view of FIG. 13.
Figure 13:
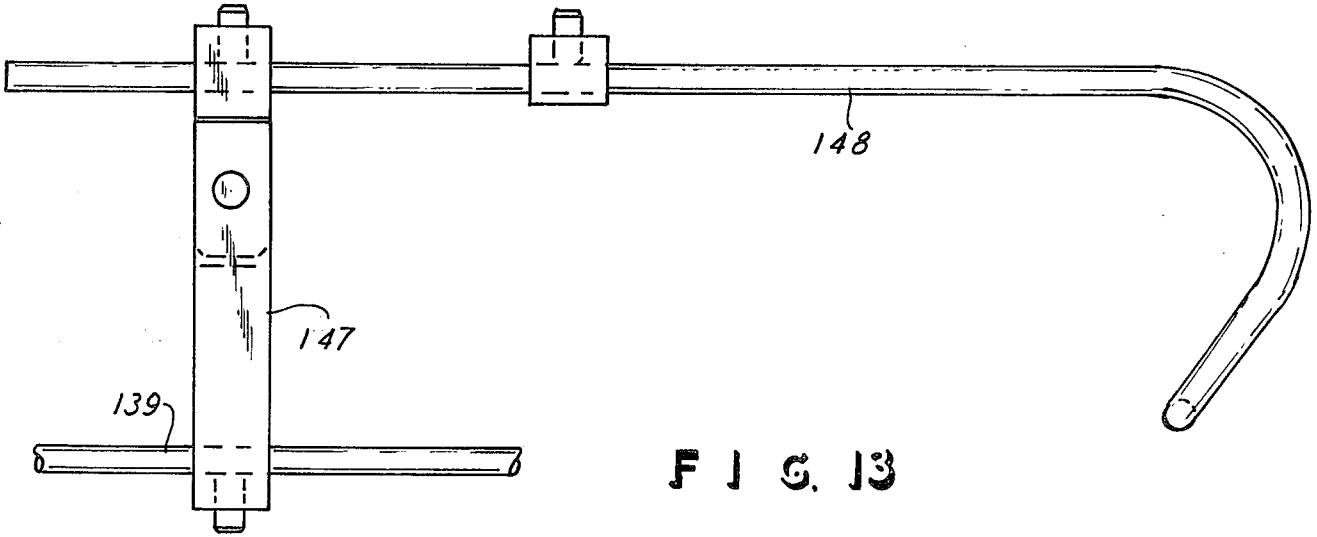
FIG. 13 is a side elevational view of a part of the machine shown in FIGS. 7, 8, and 9.

FIG. 12 shows an end view of the tape head assembly just described. Also, with that construction, it will be understood that the tape positioning bar 148 and the roller 146 will eventually fall away from the relative position shown in FIG. 8, for instance, when the tape head has rotated sufficiently clockwise around the work piece, and those two pieces 148 and 146 will return to the positions shown in FIG. 8 when there has been sufficient amount of the 360 degree rotation of the tape head, since they simply are controlled in their downward movement by gravity. FIGS. 13 and 14 show further details of the tape positioning bar or finger 148 and its mounting posts 147. FIG. 9 shows the function of the positioning bar or finger 148 when it engages the tape T prior to the time that the knife 108 cuts the tape, and the bar 148 then positions the tape as shown in FIG. 7 so that the tape head and the tape T are ready for the next cycle and the tape is aligned and in position relative to the work piece. It will also be understood that the tape head, and particularly the position of the rollers 133 and 134, remains as shown in FIG. 8 while the tape head revolves for one full revolution of 360 degrees around the work piece.

FIGS. 7, 8, and 12 show a knife mounting block 152 suitably attached to the rotatable ring 81 and pivotly supporting the blade 108 by means of the blade support arm 153 and the pivot pin 154. With that arrangement, the block 152 and the knife or blade arm 153, along with the blade 108, all revolve around the work piece upon rotation of the gear 44, and the blade 108 will move from the position shown in FIG. 8 to the position shown in FIG. 9 and then to the position shown in FIG. 7, all as described hereinafter. It would also be noticed that there is a knife arm stop 156 attached to the mounting block 152 for locating the arm 153 in the inoperative or FIG. 8 position. Further, a tension spring 157 attaches to the arm 153 and is affixed to a piece 158 which is suitably bolted to the gear 44, in a manner hereinafter described, to rotate with the gear 44. Thus, the mounting block 152 is bolted to the gear 44 through the bolt 159, and it will be noted that there is an adjustment slot 161 in the mounting block 152 so that the block can be slid to the left or right, as viewed, and thus the position of the knife 108 can be adjusted for relative sizes of work pieces 10, and of course also the work piece holding jaw 84 can be changed to present different size circumferential cradles or bores 85 for the different circumference of work pieces 10.

Also affixed with the gear 44 are two spaced-apart guide tracks 162 which present an opening 163 therebetween. The tracks 162 may be bolted to the gear 44, such as by the bolts 164 to rotate therewith and it will be seen that the tracks 162 can also be connected with the piece 158 for supporting the latter, such as through the bolt 166. A block 167 has a guide pin 168 which slides in the groove or opening 163, and the block 167 is attached through a connector 169 to the member 112 by means of the plate 171, all as shown in FIGS. 7 and 12, for instance. Thus, when the tape head is moved toward and away from the work piece 10, the piece 167 will slide in the groove 163 and thus control the swinging movement of the knife 108, as hereinafter described. Thus, from the position of the knife 108 in FIG. 7, the spring 157 will pull on the knife arm 153 and cause it to pivot downwardly about its mounting pin 154. It will also be noticed that there is a dog 172 which is pivoted on the pin 173 affixed to the arm 153. Further, the member 169 provides an upstanding portion 174 and a recessed or cradle portion 176 which is upwardly faced toward the dog 172. Thus, when the tape head moves to the right, the piece 169 likewise moves to the right and, with the dog 172 lowered under the force of the spring 157, the dog 172 is positioned in the cradle 176, as shown in FIG. 8. At that time the knife arm 153 has also dropped down to the position of FIG. 8 and is held down or away from the work piece and the tape head until approximately one complete revolution is made by the tape head.

After the one complete revolution, the tape head is moved to the position shown in FIG. 9 when the movable segment 16 has started to open. That movement causes the piece 169 to also move to the left and thus engage the knife dog 172 and thereby pivot the knife arm 153 upwardly to present the blade 108 to the tape T, as shown in FIG. 9. It will now also be seen and mentioned that a second presser finger 177, which is suitably connected with the arm 153, is pressed against the tape T which is already overlapping the work piece 10, at the location designated 178 in FIG. 9, and thus the tape T is again firmly pressed against the work piece 10. The presser finger or member 177 is a spring piece and it will actually be spring urged against the wrapped tape T supported by the work piece 10, and the spring may actually flatten under the pressure, as indicated in FIG. 7 and thus the tape T is securely pressed against the work piece as it is throughout the entire process of applying the tape to the work piece.

Further opening of the segment 16, that is from the position of FIG. 9 to the position of FIG. 7, will cause the projecting piece 174 to further pull the dog 172 and thus swing the arm 153 further upwardly to where the knife 108 will cut the tape T. Further subsequent movement will also have the presser finger 177 finally press the very cut edge of the tape T downwardly against the work piece. In this manner, the tape T is positively pressed against the work piece at the very beginning of the application of the tape against the work piece and at the very end thereof, and the tape is overlapped on the work piece, as desired, and it is therefore straight and secure with the work piece and the action of the overlapping involves approximately 405 degrees of rotation about the work piece, though the tape head itself rotated only one complete revolution of 360 degrees. In furtherance of control of the dog 172, an arm 179 extends from the piece 181 which is a part of the two rails 162, and there is also a piece 182 which extends across the path of the swinging dog 172 for controlling the movement of the dog 172 along with the upstanding portion 174 of the member 169. Adjustments, such as in the member 179 and the member 158 and the member 152 and the member 142 and the tape spool support 116, all as indicated in the drawings, are also incorporated in the machine and thus accommodate desired critical positioning of the various parts and also accommodate different sizes of work piece and different sizes of rolls of tape 88. Further, the tension for the springs 122 and 123 can be adjusted, such as by adjustment of the position of cotter pins 183 which extend through the respective rods around which those two springs are located, and thus the actual amount of tension of the tape applying belt 136 can be governed. Further, in both instances of the first presser member, which includes the tape 136, and the second presser member of the spring pad 177, they are both biased and spring urged so that they can firmly press against the tape on the work piece and the tape is thus pressed onto the work piece in its full 405 degree wrap therearound. In further overall view of the machine, it will be seen and understood that, in the open position of FIG. 7, the machine presents an open center 184, and, in the closed position of FIG. 8, the chuck member described completely encircles the work piece 10 and secures it in its position for the full taping action described herein. In the commencement of the taping action, and that is up to a position somewhat beyond that shown in FIG. 8, the weight of the roller 146 is against the gummed side of the tape T, and thus the roller 146 is shown to be serrated in FIG. 12 so that it will hold the tape against the belt 136 but will not stick to the tape, and thus the tape can be pulled from the roll 88 in an actual stretching manner which is most desirable, and the serration is shown at 186. After the tape is fully applied, as described, and is severed by the knife 108, the arm 153 will make a slightly further movement so that the presser member 177 will finally press the very cut end of the tape firmly against the work piece. This is accomplished by the relationship between the upstanding portion 177 of the knife control member 169 and the knife dog 172, along with the adjustments of the piece 169 and the mounting piece 152.

What is claimed is:

1. A machine for wrapping tape around an object, comprising a rotatably mounted work-piece chuck, means for rotating said chuck in one complete circle, a tape carrier attached to said chuck to rotate therewith and carry a supply of tape having a free end, a first presser member supported on said chuck for rotating around in one complete circle with said chuck and extending into bearing relationship with the work piece, advancing means connected with said chuck and said first presser for moving said first presser into contact with the tape free end and throughout all the one complete rotation of said chuck for pressing the tape free end and the following length of tape against the work piece and completely therearound, a cutter for cutting the end of the tape after the tape is wrapped around the work piece, and a second presser member supported on said chuck and being movable into bearing relationship with the work piece and into contact with the cut end of the tape for pressing the cut tape end against the work piece.

2. The machine for wrapping tape around an object as claimed in claim 1, wherein said first presser member is a biased member arranged to yieldingly bear against the work piece and follow a path conforming to the periphery of the work piece.

3. The machine for wrapping tape around an object as claimed in claim 2, wherein said first presser member is spring-biased.

4. The machine for wrapping tape around an object as claimed in claim 3, wherein said first presser member includes an endless belt and rotatable supports for said endless belt for yieldingly urging said belt against the work piece.

5. The machine for wrapping tape around an object as claimed in claim 1, 2, 3, or 4, wherein said second presser member is a biased member arranged to yieldingly bear against the work piece and follow a path conforming to the periphery of the work piece.

6. The machine for wrapping tape around an object as claimed in claim 1, including a movable member mounted on said chuck and having said cutter and said second pressure mounted thereon in tandem relation such that said movable member moves said cutter against the tape and thereafter continues to press said second pressure member against the tape to secure the cut end of the tape with the work piece.

7. The machine for wrapping tape around an object as claimed in claim 1, 2, 3, or 4, including a movable member mounted on said chuck and movable toward and away from said first presser member for holding the tape onto said first presser member when said first presser member is free of the work piece.

8. The machine for wrapping tape around an object as claimed in claim 1, wherein said means for rotating said chuck includes an air cylinder assembly for cycling said chuck in intervals of one revolution for completely wrapping the work piece with the tape.

9. The machine for wrapping tape around an object as claimed in claim 1, wherein said presser members are spring-biased members, and adjustment means connected with said spring-biased members for adjustably controlling said spring-biased members.

10. The machine for wrapping tape around an object as claimed in claim 1, wherein said chuck has a circular center opening therein for snugly receiving and completely surrounding a cylindrically-shaped work piece.

11. The machine for wrapping tape around an object as claimed in claim 1, wherein said means for rotating said chuck includes a driven member and a guide track for movement of said driven member along said track to impart driving motion to said chuck.

12. The machine for wrapping tape around an object as claimed in claim 8, wherein said means for rotating said chuck includes a driven member connected with said air cylinder and a guide track included in said means for movement of said driven member along said track to impart driving motion to said chuck.

13. The machine for wrapping tape around an object, comprising a rotatably mounted work-piece chuck, means for rotating said chuck, a tape carrier attached to said chuck to rotate therewith and carry a supply of tape, a member supported on said chuck for rotating with said chuck and extending into bearing relationship with the work piece and into contact with the tape for pressing the tape against the work piece, a cutter for cutting the end of the tape after the tape is wrapped around the work piece, said chuck having an enclosed elongated central opening for receiving the work piece, and said chuck having a segment separable from the remainder of said chuck and extending to said central opening for exposing said central opening when moved away from said remainder, to allow the reception of the work piece into said central opening by movement in the direction transverse to the longitudinal axis of said central opening.

14. The machine for wrapping tape around an object as claimed in claim 13, including a slide guide supporting said separable chuck segment for guided movement of said separable chuck segment to open and close said central opening for the insertion and withdrawal of the work piece.

15. The machine for wrapping tape around an object as claimed in claim 13, wherein said chuck includes a driven gear having a segment separable with the remainder of the separable chuck segment, and said means for rotating said chuck including a driving gear in mesh with said driven gear.

16. The machine for wrapping tape around an object as claimed in claim 15, including a second presser member supported on said chuck and being movable into bearing relationship with the work piece and into contact with the cut end of the tape for pressing the cut tape end against the work piece.

17. The machine for wrapping tape around an object as claimed in claim 13, including powered means for rotating said chuck and powered means for moving said chuck segment, a source of power connected with both said powered means, and control means interconnected with both said source of power and both said powered means for alternately directing said source of power to both said powered means.

18. The machine for wrapping tape around an object as claimed in claim 17, wherein both said powered means include fluid cylinder assemblies, and said source of power is pressurized fluid for said assemblies.

19. The machine for wrapping tape around an object as claimed in claim 17 or 18, wherein said control means is a fluid switching valve means.

20. The machine for wrapping tape around an object as claimed in claim 13, including lock means operatably connected with said means for rotating said chuck, for locking said chuck in the closed position.

* * * * *

UNITED STATES PATENT AND TRADEMARK OFFICE

CERTIFICATE OF CORRECTION

PATENT NO. : 4,264,398

DATED : April 28, 1981

INVENTOR(S) : Leonard H. Pruitt

It is certified that error appears in the above-identified patent and that said Letters Patent are hereby corrected as shown below:

In column 10, line 60, "pressure" should read

-- presser--

In column 10, line 63, "pressure" should read

--presser--

Signed and Sealed this

*Twenty-fifth* Day of *August 1981*

[SEAL]

*Attest:*

GERALD J. MOSSINGHOFF

*Attesting Officer*

*Commissioner of Patents and Trademarks*